US006354936B1

(12) United States Patent
Noh et al.

(10) Patent No.: US 6,354,936 B1
(45) Date of Patent: Mar. 12, 2002

(54) OPENING-CLOSING STRUCTURE OF AN INLET GRILLE IN AN AIR CONDITIONER

(75) Inventors: Jung Ho Noh, Kimhae-shi; Chul Shin Chung, Kunpo-shi, both of (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/371,511

(22) Filed: Aug. 10, 1999

(30) Foreign Application Priority Data

Aug. 10, 1998 (KR) ..... 98-33171
Nov. 27, 1998 (KR) ..... 98-51206

(51) Int. Cl.[7] ..... F24F 1/02
(52) U.S. Cl. ..... 454/201; 16/361; 55/493
(58) Field of Search ..... 454/201; 16/357, 16/361; 55/493; 62/262

(56) References Cited

U.S. PATENT DOCUMENTS 472,622 A * 4/1892 Linkletter
2,575,499 A * 11/1951 Manow
4,068,348 A * 1/1978 Chivers
4,743,281 A 5/1988 Kennedy et al.

* cited by examiner

*Primary Examiner*—Harold Joyce

(57) ABSTRACT

An opening-closing structure of an inlet grille in an air conditioner including a front grille facing an inlet grille. A rotating shaft is connected to the inlet grille. A support member with non-circular connecting holes is connected to the front grille. A hinge is formed from the rotating shaft and support member, such that the shaft is inserted into the connecting holes.

8 Claims, 10 Drawing Sheets

OPENING-CLOSING STRUCTURE OF AN INLET GRILLE IN AN AIR CONDITIONER

BACKGROUND OF THE INVENTION

1. Field of the Invention

This invention relates to an air conditioner, and more particularly, to an opening-closing structure of an inlet grille in a window-type air conditioner.

2. Description of the Background Art

In general, types of the air conditioner is classified into a top-provided-type, a wall-mounted-type, and a window-type.

The top-provided-type air conditioner is provided on the floor, the wall-mounted-type air conditioner is mounted on a wall in an indoor room, and the window-type air conditioner is placed in a window. The top-provided-type and wall-mounted-type air conditioners have a indoor device and an outdoor device, but the window-type air conditioner have a single device which includes the indoor device and the outdoor device.

Referring to FIG. 1, a conventional window-type air conditioner is described hereinafter.

FIG. 1 is a perspective view showing the conventional window-type air conditioner.

The air conditioner represented by FIG. 1 includes a body 1 having a plurality of outlets 1*a*, which are located outdoors when the air conditioner is provided in a window (not illustrated), a front grille 2, an air filter 3 for collection of a dust in the air and provided on the front grille 2, an inlet grille 4 having a plurality of inlets 4*a*, horizontal and vertical louvers 5, 6 for controlling a direction of cold air from the interior of the body 1, the indoor heat exchanger (not illustrated) changing hot air to cold air by a ventilator (not illustrated) provided in a rear side of the front grille 2, a scroll informing the cold air to the horizontal and vertical louvers 5, 6, an outdoor heat exchanger (not illustrated) for heat-exchanging the outdoor air, and a control unit 7 controlling a driving mode which is provided on one side of the front grille 2.

When the user operates a switch of the control unit 7 to the cooling mode, the air conditioner is driven in the cooling mode according to a fixed control signal.

Namely, if the cooling cycle is made by driving a compressor according to a selected control signal, the temperature of the indoor heat exchanger is decreased. At this status, when the indoor hot air is inserted to the interior of the body 1 through the inlet 4*a* on the grille 4 by rotating the ventilator, the temperature of the indoor air is decreased because the indoor hot air is flowed through refrigerant pipes.

By the above, it is possible to drive the air conditioner in a continual cooling cycle.

In the air conditioner, the air filter 3 provided on the front grille 2 collects fine dust in the indoor air when the indoor air is inhaled into the body 1 by an inhalation force according to the operation of the ventilator.

For a high degree of inhalation efficiency, when a lot of dust is collected on the air filter 3, the inlet grille 4 is combined with the front grille 2 separately.

FIG. 2 is a disassemble perspective view showing a hinge structure of the conventional inlet grille.

Referring to FIG. 2, a connecting hole 8 is formed on an upper side of the front grille 2, and a rotating shaft 9 which functions as a hinge is formed on the interior side of the inlet grille 4 and inserted into the connecting hole 8.

In addition, a pair of locking sides 10 having elastic force are formed on lower side of the front grille 2, and a hanging protrusion 11 for maintenance of locking status is formed on the lower side of the inlet grille 4, as shown in FIG. 3. The air filter 3 must be separated from the front grille 2 in case there is a lot of dust on the air filter 3. In handhold status of the inlet grille 4, if a user pulls the lower side of the inlet grille 4, the hanging protrusion 11 between the locking sides 10 is released. The inlet grille 4 is opened rotating around the rotating shaft 9. Thereby, the air filter 3 may be separated from the front grille 2, as shown in FIG. 4.

However, by the above structure, the inlet grille 4 is opened in a direction, which makes separation of the air filter 3 from the front grille 2 is difficult when the air conditioner is provided near the floor.

SUMMARY OF THE INVENTION

It is an object of the present invention to provide an opening-closing structure of an inlet grille in an air conditioner in which the air filter is freely separated from the front grille.

In order to achieve the above-mentioned objects, the opening-closing structure of an inlet grille in an air conditioner according to the present invention includes a front grille and inlet grille symmetrically facing each other centering around the horizontal center line, at least one locking side on the front grille for connecting a hanging protrusion on the inlet grille, a connecting hole or rotating shaft on the lower side of the front grille for connecting with a connecting hole or rotating shaft on the upper side of the inlet grille. Thereby, the inlet grille being opened or closed centering around the lower side of the front grille.

According to another aspect of the present invention, the opening-closing structure of an inlet grille in an air conditioner according to the present invention includes a front grille and inlet grille symmetrically facing each other centering around the vertical center line, at least one locking side on the front grille for connecting with at least one hanging protrusion on the inlet grille, a connecting hole or rotating shaft on the lower side of the front grille for connecting with a connecting hole or rotating shaft on the upper side of the inlet grille. Thereby, the inlet grille being opened or closed centering around the lower side of the front grille.

According to a further aspect of the invention, the opening-closing structure of an inlet grille in an air conditioner according to the present invention comprises a front grille an inlet grille symmetrically facing each other, wherein a hinge of the inlet grille, which is connected with the front grille, is moved at static trace by the supporting member having connecting holes on the lower side of the front grille. Thereby, an upper-opening of the inlet grille by a lower hinge is possible when the air conditioner is located on the floor.

According to a further aspect of the invention, the opening-closing structure of an inlet grille in an air conditioner according to the present invention includes a front grille and inlet grille symmetrically facing each other, wherein a hinge of the inlet grille, which is connected with the front grille, is moved at static trace by the supporting member having connecting holes on the upper side of the front grille. Thereby, a lower-opening of the inlet grille by an upper hinge is possible when the air conditioner is located on the roof.

BRIEF DESCRIPTION OF THE DRAWINGS

FIG. 6A depicts a lower-opening of the inlet grille by an upper hinge and FIG. 6B depicts an upper-opening of the inlet grille by an lower hinge.

FIG. 8A depicts a left-opening of the inlet grille by a right hinge and FIG. 8B depicts a right-opening of the inlet grille by a left hinge.

DETAILED DESCRIPTION OF THE INVENTION

Preferred embodiments of the present invention are described in detail hereinafter by accompanying drawings.

Figure 1:
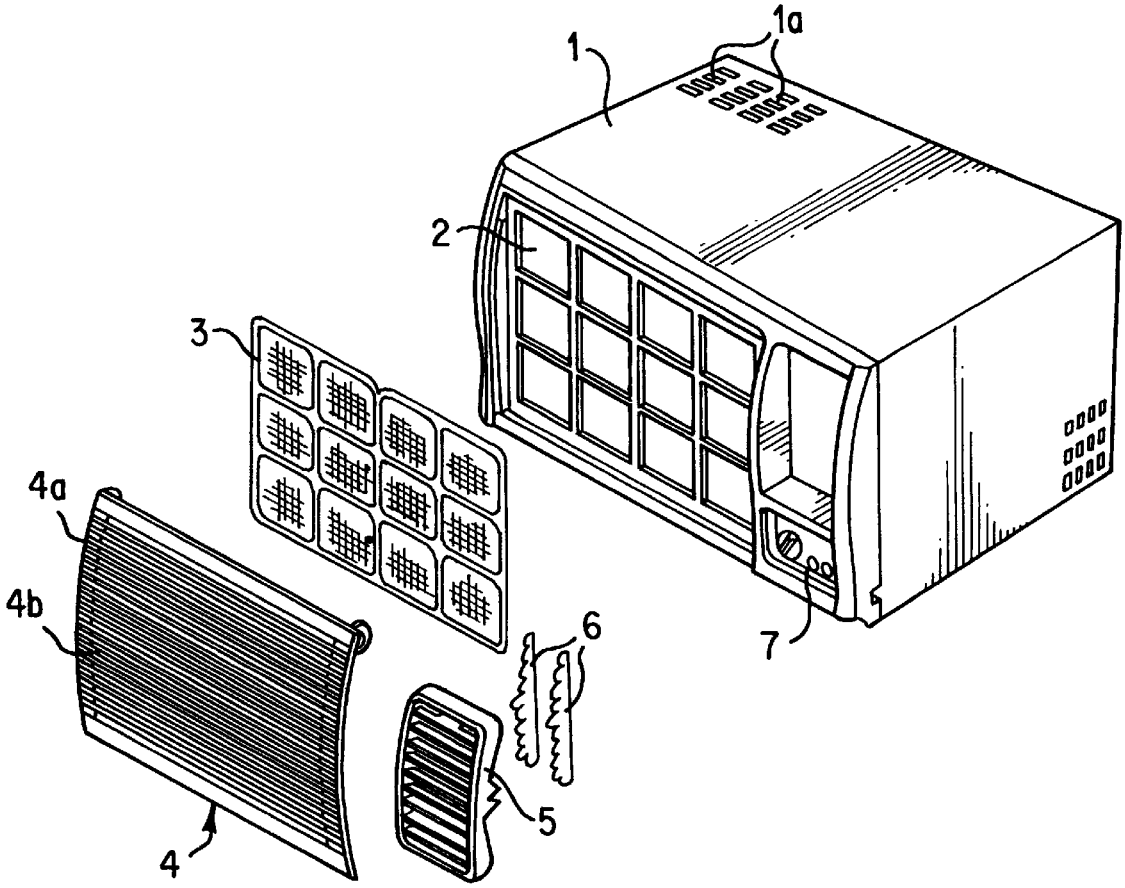
FIG. 1 PRIOR ART
FIG. 1 is a perspective view showing a conventional window-type air conditioner.
Figure 2:
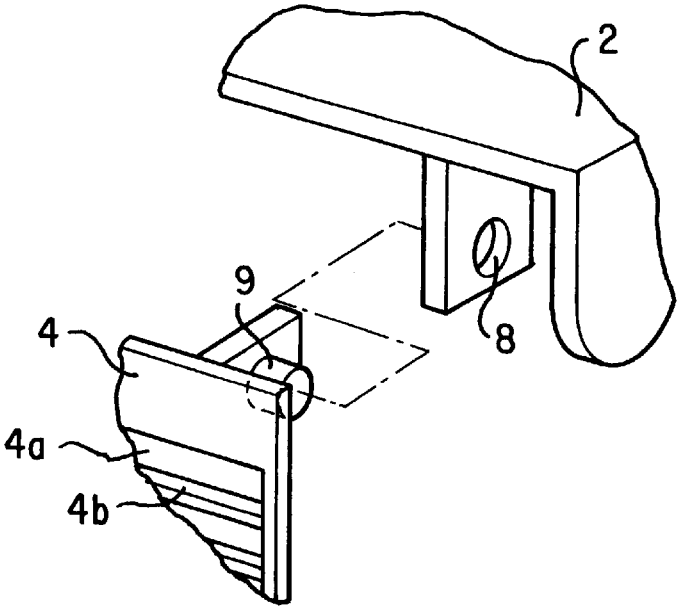
FIG. 2 PRIOR ART
FIG. 2 is a disassemble perspective view showing a conventional hinge structure.
Figure 3:
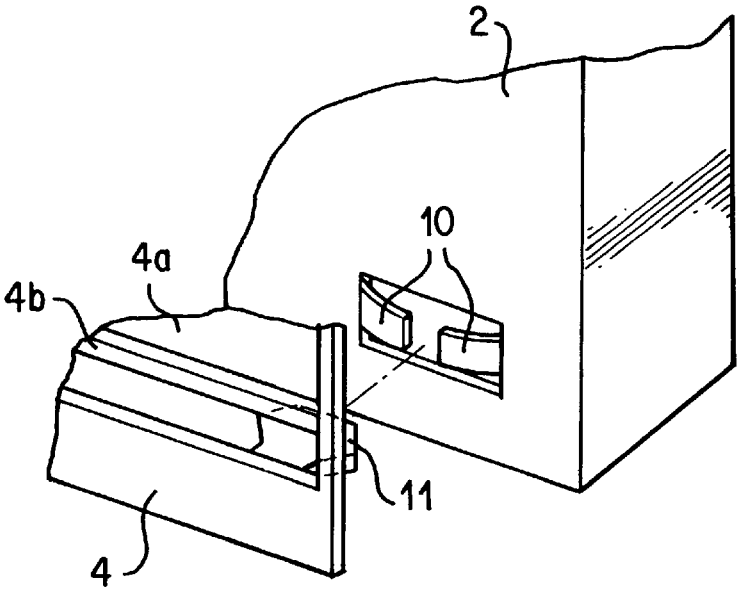
FIG. 3 PRIOR ART
FIG. 3 is a disassemble perspective view showing a conventional locking structure.
Figure 4:
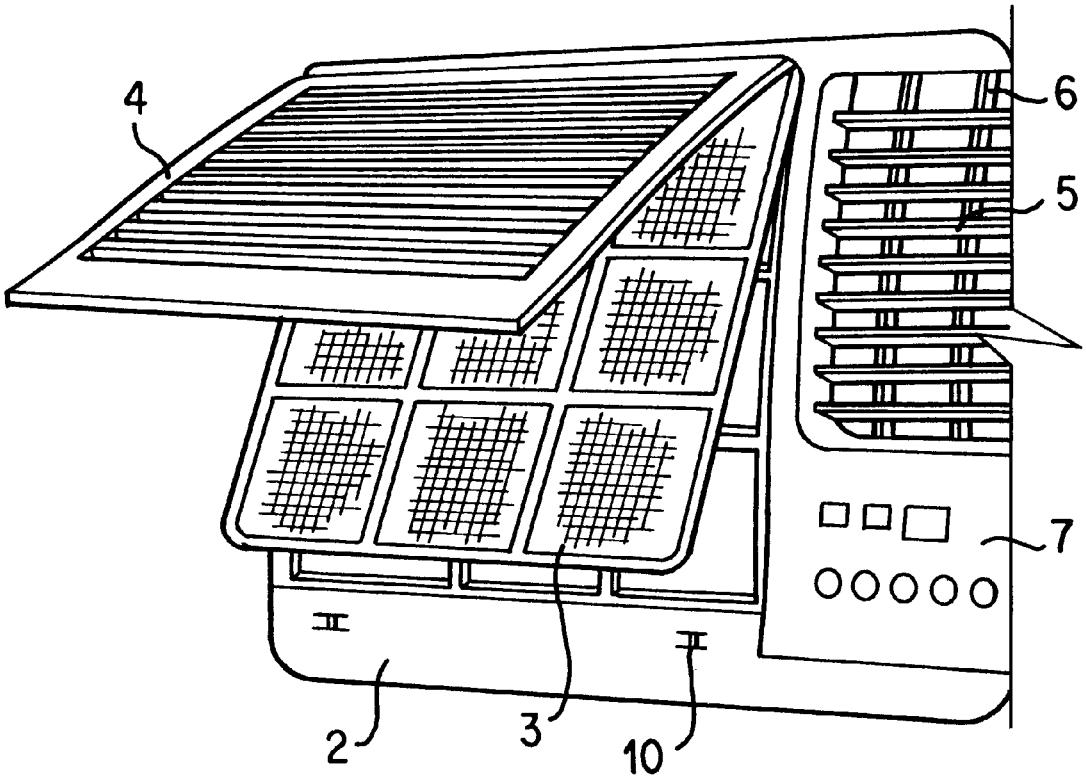
FIG. 4 PRIOR ART
FIG. 4 is a perspective view showing a separation of an air filter.
Figure 5A:
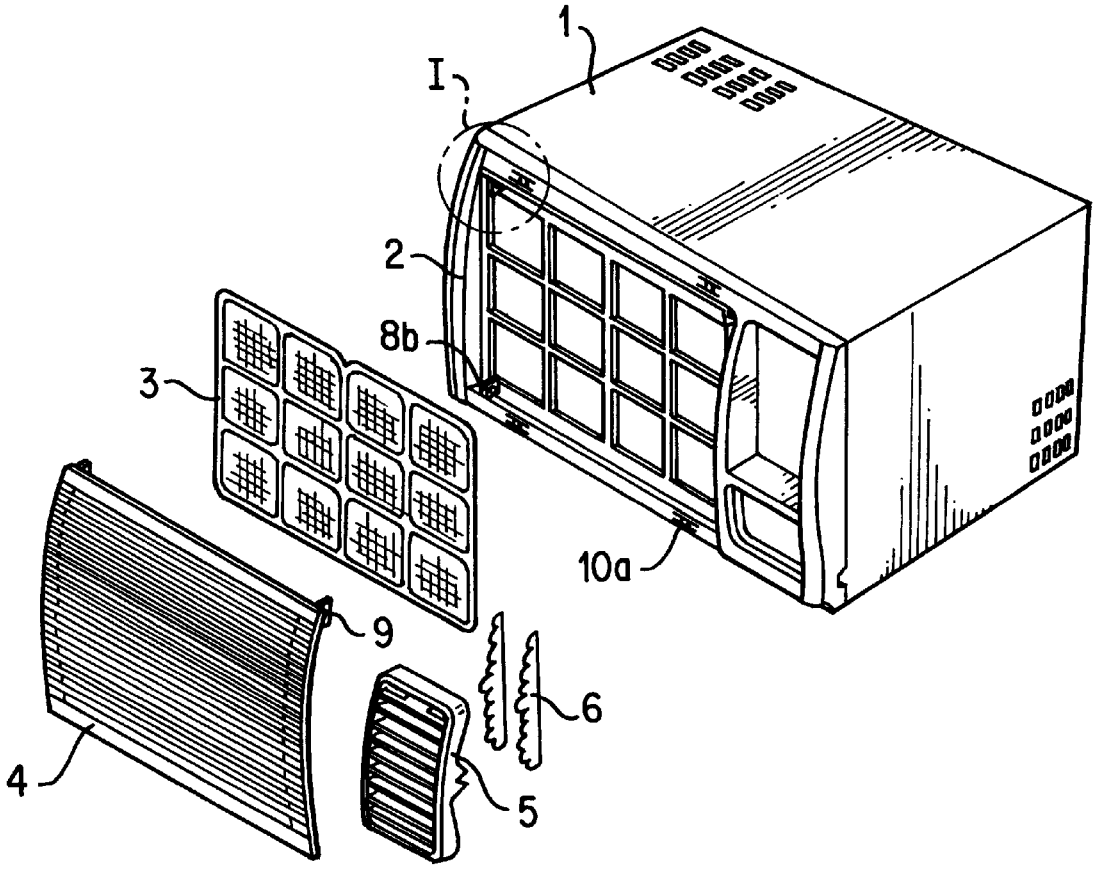
FIG. 5A is a disassemble perspective view showing a first embodiment according to the present invention.
Figure 5B:
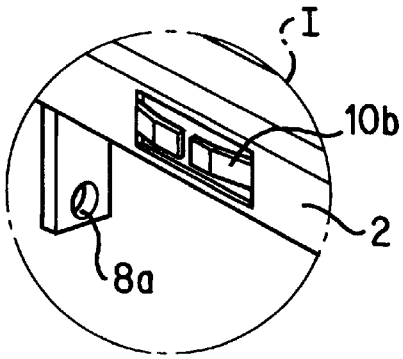
FIG. 5B depicts cross-section I of FIG. 5A.
Figure 6A:
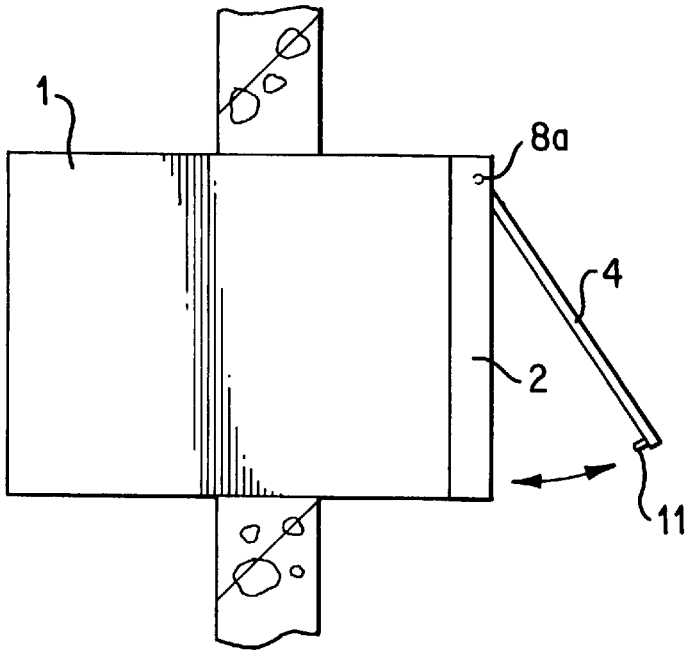
FIG. 6A and FIG. 6B are side views showing a separation of an inlet grille according to the first embodiment.
Figure 6B:
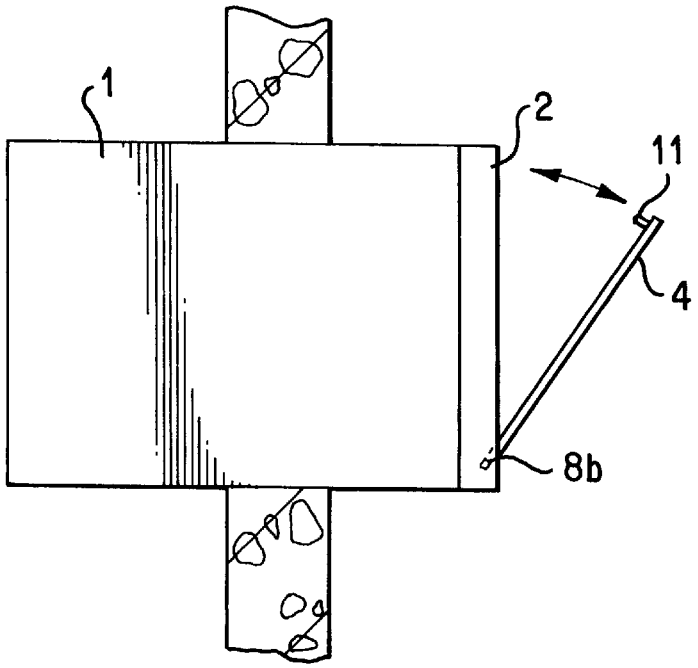

FIG. 5A is a disassemble perspective view showing a first embodiment according to the present invention; FIG. 5B shows cross-section I of FIG. 5A; and FIG. 6A and FIG. 6B are side views showing a separation of an inlet grille according to the first embodiment. As shown in the figures, a front grille 2 and inlet grille 4 are symmetrically facing each other centering around the horizontal center line. A pair of connecting holes 8*a*, 8*b* are formed on two sides on upper and lower sides of the front grille 2 having an air filter 3. A rotating shaft 9 is selectively inserted into the connecting holes 8*a*, 8*b* formed on two sides of the inlet grille 4, which is provided moveably with the front grille 2. At this time, it is possible that the connecting holes 8*a*, 8*b* and the rotating shaft 9 may be formed alternatively to each other.

Further, at least one locking side 10*a*, 10*b* are formed on upper and lower sides of the front grille 2 and a hanging protrusion 11 is formed on the inlet grille 4, which is locked selectively into the locking sides 10*a*, 10*b*.

Referring to FIG. 6A and FIG. 6B, when user takes out the air filter 3 from the front grille 2 centering around the upper side of the front grille 2, the rotating shaft 9 remains connected to the connecting hole 8*a* on the front grille 2. Then, the hanging protrusion 11 formed on the inlet grille 4 maintains a locking status of the inlet grille 4 by insertion into the locking side 10*a* on the front grille 2. If cleaning of the air filter 3 is needed due to collected dust on the air filter 3, it is necessary to unlock the locking status of the hanging protrusion 11 being inserted to the locking side 10*a*. After that, if the inlet grille 4 is moved in an arrow direction shown in FIG. 6A, the air filter 3 is separated by an lower-opening of the inlet grille 4 by an upper hinge.

After cleaning the air filter 3, the air filter 3 is again provided to the front grille 2. The locking status is maintained by inserting the hanging protrusion 11 formed on the inlet grille 4 into the locking side 10*a*. Thereby, the air filter 3 is not seceded from the front grille 2.

However, if a window, which the air conditioner is located is near the floor, changing direction of opening-closing direction of the inlet grille 4 is required due to a narrow space. If the inlet grille 4 is connected the front grille 2 centering around the upper side, the rotating shaft 9 have to be inserted into the connecting hole 8*b* formed on lower side of the front grille 2 after separating the inlet grille 4 from the front grille 2 and changing direction of the rotating shaft 9 at 180°. In this status, if cleaning of the air filter 3 is needed due to collected dust on it, it is necessary to unlock the locking status of the hanging protrusion 11 being inserted to the locking side 10*a*. After that, if the inlet grille 4 is moved in the arrow direction shown in FIG. 6B, the air filter 3 is separated by an upper-opening of the inlet grille 4 by an lower hinge. By reproviding the front grille 2 after cleaning the air filter 3, the air filter 3 collects the dusts in the indoor air.

Figure 7A:
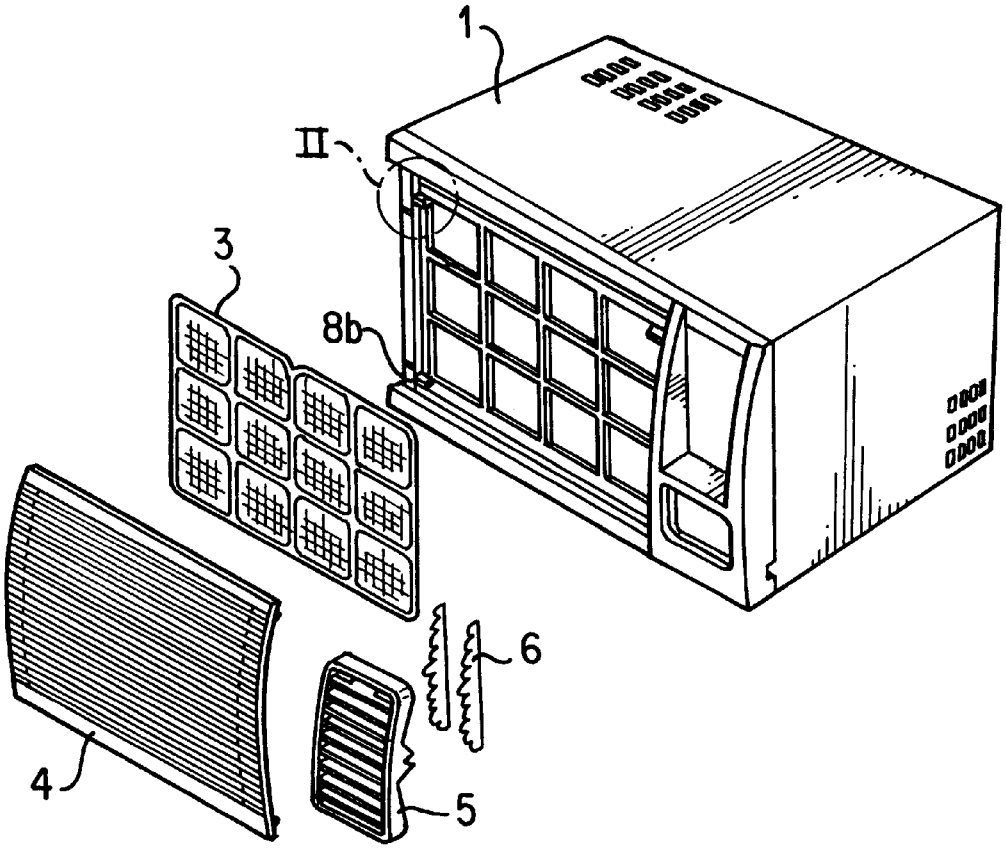
FIG. 7A is a disassemble perspective view showing a second embodiment according to the present invention.
Figure 7B:
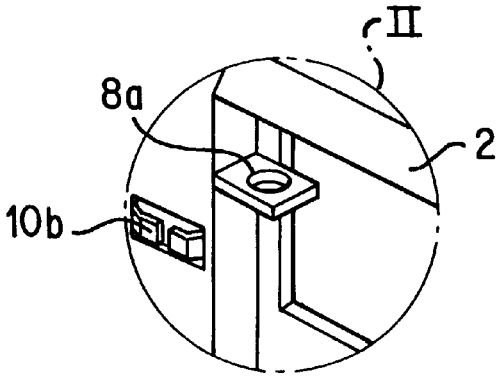
FIG. 7B depicts cross-section II of FIG. 7B.
Figure 8A:
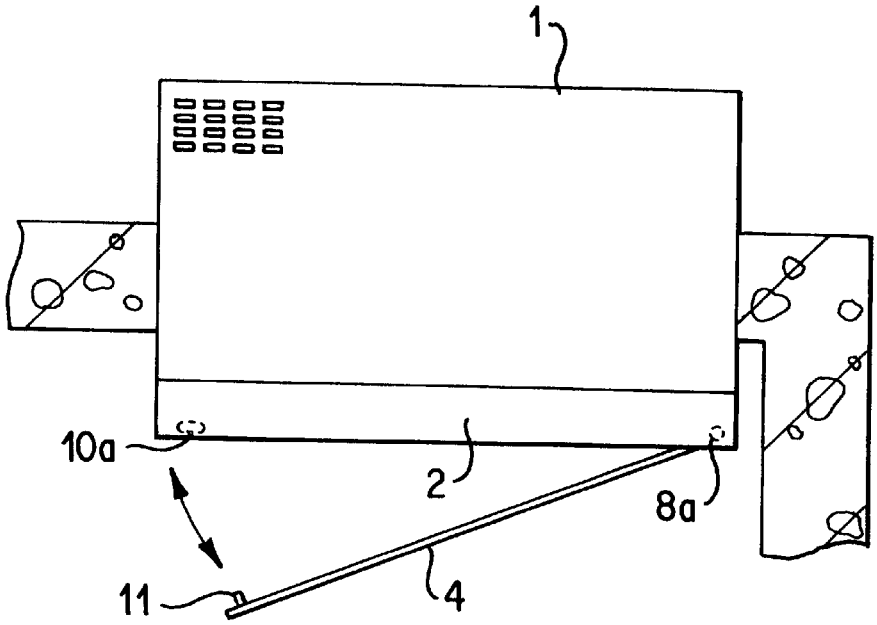
FIG. 8A and FIG. 8B are side views showing a separation of an inlet grille according to the second embodiment.
Figure 8B:
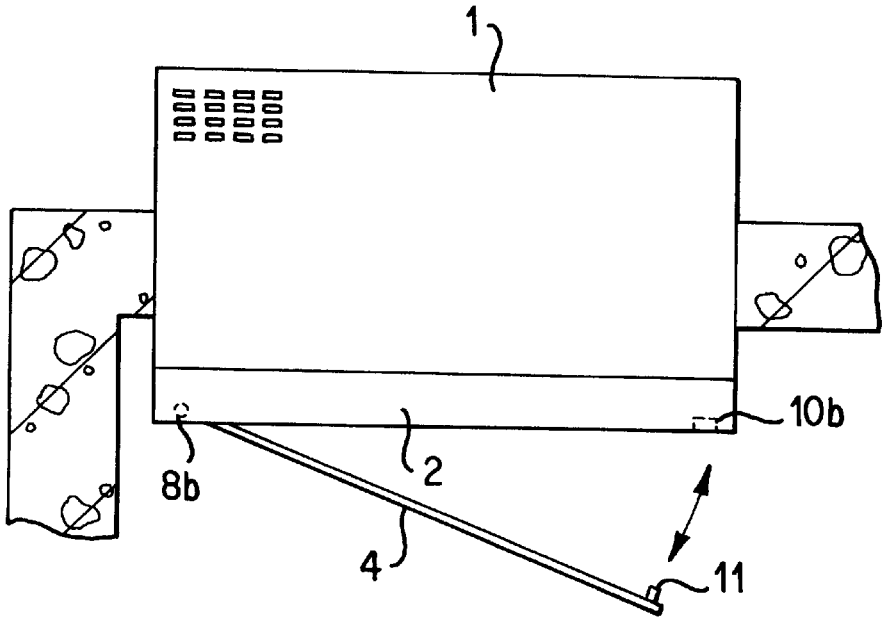

FIG. 7A is a disassemble perspective view showing a second embodiment according to the present invention; FIG. 7B depicts cross-section II of FIG. 7A; and FIG. 8A and FIG. 8B are side views showing a separation of an inlet grille according to the second embodiment. As shown in the figures, the difference between the second embodiment and the first embodiment of the present invention is that the inlet grille 4 is opened and closed to the front grille 2 according to the wall structure.

Referring to figures, a front grille 2 and inlet grille 4 symmetrically facing each other and centering around the vertical center line. By this symmetry, if the front grille 2 and the inlet grille 4 are connected oppositely, the front of the air conditioner has a same plane or slope. At least one locking side 10*a*, 10*b* are formed between the connecting hole 8*a*, 8*b* formed on four sides on upper, lower, left, and right sides of the front grille 2 having an air filter 3.

As shown in FIGS. 8A and 8B, when a user takes out the air filter 3 from the front grille 2 centering around the upper side of the front grille 2, the rotating shaft 9 has to be connected to the connecting hole 8*a* on the front grille 2. Then, the hanging protrusion 11 formed on the inlet grille 4 maintains a locking status of the inlet grille 4 by insertion into the locking side 10*a* on the front grille 2. If cleaning of the air filter 3 is needed due to collected dust on the air filter 3, it is necessary to unlock the locking status of the hanging protrusion 11 being inserted to the locking side 10*a*. After that, if the inlet grille 4 is moved in the arrow direction shown in FIG. 8A, the air filter 3 is separated by a left-opening of the inlet grille 4 by a right hinge.

After cleaning the air filter 3, the air filter 3 is provided again to the front grille 2. The locking status is maintained by inserting the hanging protrusion 11 formed on the inlet grille 4 into the locking side 10*a*. Thereby, the air filter 3 is not seceded from the front grille 2.

However, if a window in which the air conditioner is located is on the right side of the wall, changing direction of opening-closing direction of the inlet grille 4 is needed due to a narrow space. If the inlet grille 4 is connected the front grille 2 rotating around the right side, the rotating shaft 9 has to be inserted into the connecting hole 8*b* formed on lower side of the front grille 2 after separating the inlet grille 4 from the front grille 2 and changing direction of the rotating shaft 9 at 180°. In this status, if cleaning of the air filter 3 is needed due to collected dust on it, it is necessary to unlock the locking status of the hanging protrusion 11 being inserted to the locking side 10*a*. After that, if the inlet grille 4 is moved in the arrow direction shown in FIG. 8B, the air filter 3 is separated by a right-opening of the inlet grille 4 by a left hinge. By re-providing the front grille 2 after cleaning the air filter 3, the air filter 3 collects the dusts in the indoor air.

Figure 9:
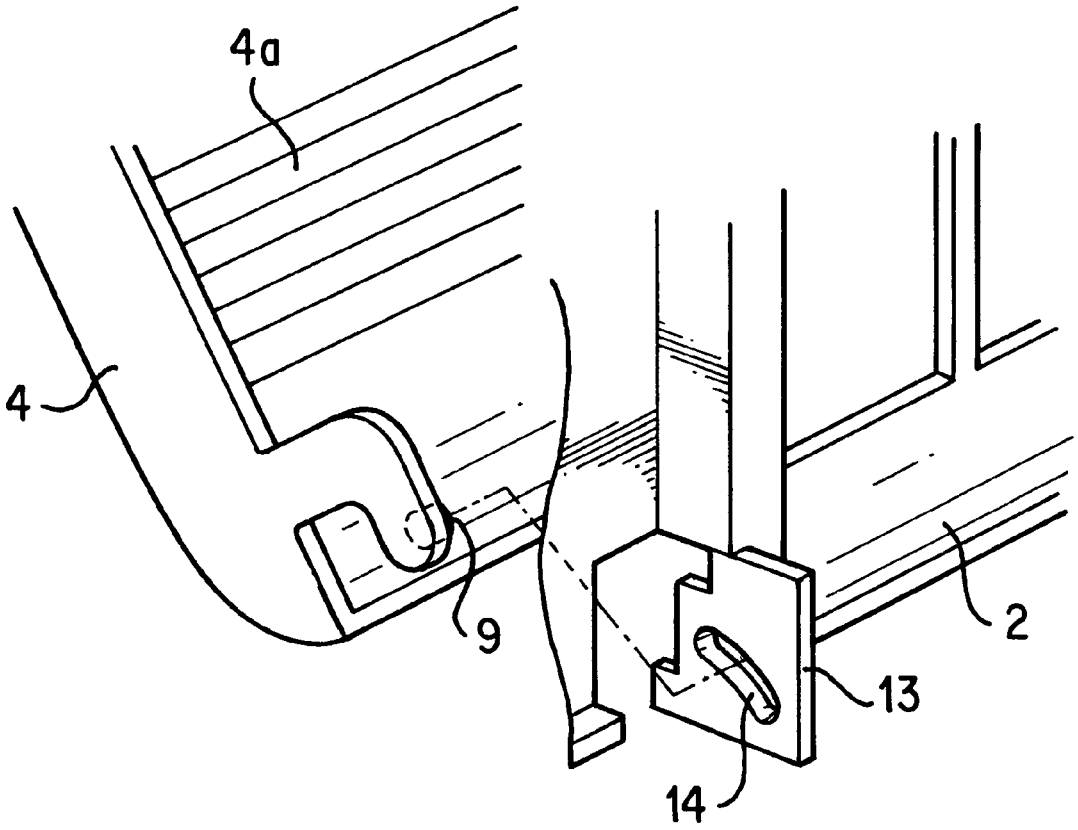
FIG. 9 is a disassemble perspective view showing a third embodiment according to the present invention.
Figure 10A:
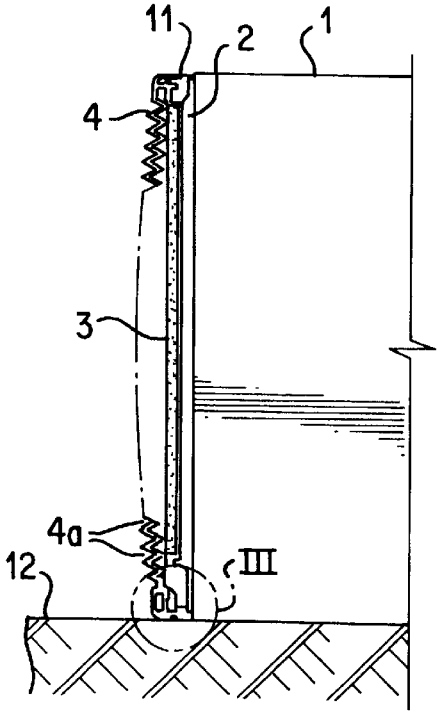
FIG. 10A is a side view of a third embodiment according to the present invention, and depicting a closing of the inlet grille.
Figure 10B:
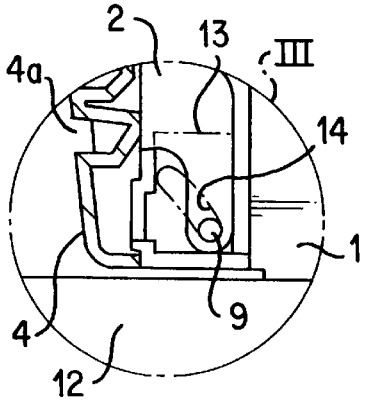
FIG. 10B depicts cross-section III of FIG. 10A.
Figure 10C:
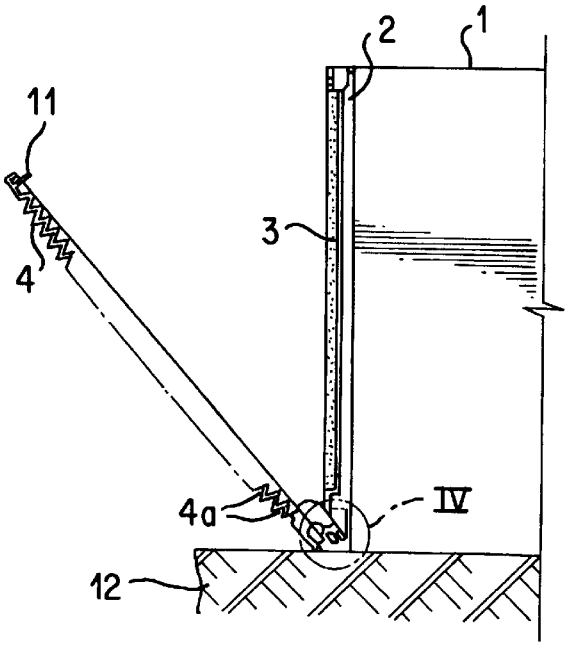
FIG. 10C is a side view of the third embodiment according to the present invention and depicts the opening of the inlet grille.
Figure 10D:
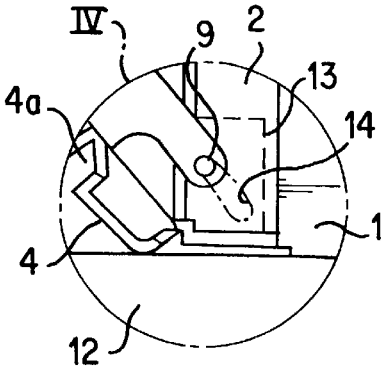
FIG. 10D depicts cross-section IV of FIG. 10C.

FIG. 9 is a disassemble perspective view showing a third embodiment according to the present invention. FIG. 10A and FIG. 10C are side views showing a separation of an inlet grille according to the third embodiment, FIG. 10A represents a closing of the inlet grille and FIG. 10C represents an upper-opening of the inlet grille by a lower hinge. FIGS. 10B and 10D depict cross-sections III and IV of FIGS. 10A and 10C, respectively.

As shown in the drawings, the main point of this embodiment is that a complete opening of the inlet grille 4 having a plurality of inlets 4a from the front grille 2 is possible because the hinge point is moveable when the air conditioner is located on the floor 12. Namely, the hinge point of the inlet grille 4, which is connected with the front grille 2, is moved at static trace by the supporting member 13 having a connecting hole 14 on the lower side of the front grille 2. Thereby, an upper-opening of the inlet grille 4 by a lower hinge is possible.

The connecting hole 14 is bent in order to preferably drive the rotating shaft 9. However, there is no need to bend the connecting hole 14 because it is possible to open the inlet grille 4 from the front grille 2 completely by changing the hinge point.

If cleaning of the air filter 3 is needed due to collected dust on the air filter 3, it is necessary to unlock the locking status of the hanging protrusion 11 being inserted to the locking side.

After cleaning the air filter 3, the air filter 3 is provided again to the front grille 2.

Figure 11A:
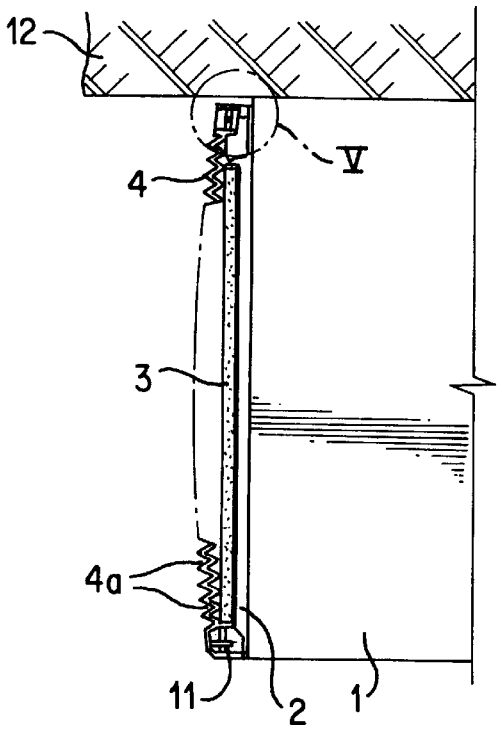
FIG. 11A is a side view showing the closing of an inlet grille according to the fourth embodiment of the present invention.
Figure 11B:
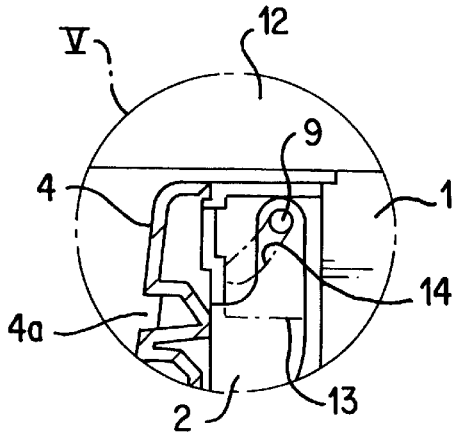
FIG. 11B depicts cross-section V of FIG. 11A.
Figure 11C:
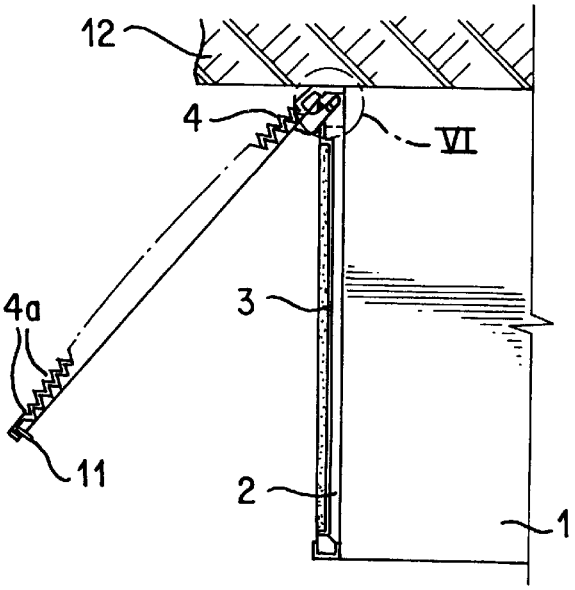
FIG. 11C depicts an opening of the inlet grille according to the fourth embodiment of the present invention.
Figure 11D:
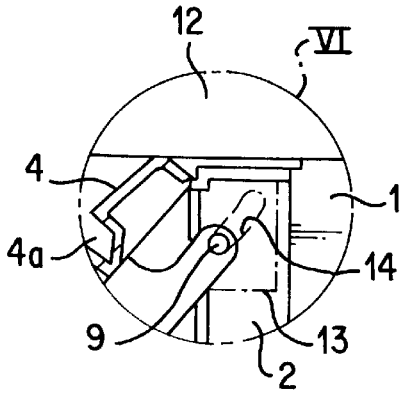
FIG. 11D depicts cross-section VI of FIG. 11C.

FIG. 11A and FIG. 11C are side views showing a separation of an inlet grille according to the fourth embodiment, FIG. 11A represents a closing of the inlet grille and FIG. 11C represents a lower-opening of the inlet grille by an upper hinge. FIGS. 11B and 11D depict cross-sections V and VI of FIGS. 11A and 11C, respectively.

As shown in the drawings, the inlet grille 4 having a plurality of inlets 4*a* is opened completely from the front grille 2 by a hinge point that is moveable when the air conditioner is located on the roof 12. Namely, the hinge point of the inlet grille 4 which is connected with the front grille 2 is moved at static trace by the supporting member 13 having a connecting hole 14 on the upper side of the front grille 2. Thereby, a lower-opening of the inlet grille 4 by an upper hinge is possible.

Structure and operation with the exception of that described above are similar to the third embodiment of the present invention.

According to the opening-closing structure of an inlet grille in a window-type air conditioner, there is no need to consider a wall structure on which the air conditioner is provided. Thereby, cleaning the air filter is simple.

While the preferred form of the present invention has been described, it is to be understood that modifications will be apparent to those skilled in the art without departing from the spirit of the invention.

The scope of the invention, therefore, is to be determined solely by the following claims.

What is claimed is:

1. An opening-closing structure of an inlet grille in an air conditioner, comprising:

a front grille facing an inlet grille;

a rotating shaft connected to the inlet grille;

a support member on the front grille, said support member having bent connecting holes; and a hinge connecting the front grille and the inlet grille, said hinge formed from the rotating shaft and the support member such that the rotating shaft is inserted into the holes of the support member.

2. The opening-closing structure of claim 1, wherein, said rotating shaft is moveable with respect to said support member.

3. The opening-closing structure of claim 1, wherein said hinge is positioned such that the hinge is adjacent a wall or floor and the inlet grille opens on a side opposite said hinge and wall or floor.

4. An opening-closing structure of an inlet grille in an air conditioner, comprising:

a front grille facing an inlet grille;

a rotating shaft connected to the inlet grille;

a support member on the front grille, said support member having non-circular connecting holes; and a hinge connecting the front grille and the inlet grille, said hinge formed from the rotating shaft and the support member such that the rotating shaft is inserted into the holes of the support member.

5. The opening-closing structure of claim 4, wherein, said rotating shaft is moveable with respect to said support member.

6. The opening-closing structure of claim 4, wherein said hinge is positioned such that the hinge is adjacent a wall or floor and the inlet grille opens on a side opposite said hinge and wall or floor.

7. The opening-closing structure of claim 4 wherein said connecting hole is oblong.

8. The opening-closing structure of claim 4, wherein said connecting hole is oblong with two sides curved and relatively longer than end sides.

* * * * *